US009049508B2

(12) United States Patent
Puskarich

(10) Patent No.: US 9,049,508 B2
(45) Date of Patent: Jun. 2, 2015

(54) EARPHONES WITH CABLE ORIENTATION SENSORS

(71) Applicant: Apple Inc., Cupertino, CA (US)

(72) Inventor: Paul G. Puskarich, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 304 days.

(21) Appl. No.: 13/689,538

(22) Filed: Nov. 29, 2012

(65) Prior Publication Data

US 2014/0146979 A1 May 29, 2014

(51) Int. Cl.

| | |
|---|---|
| ***H04R 1/10*** | (2006.01) |
| ***H04R 5/033*** | (2006.01) |
| ***H04R 5/04*** | (2006.01) |
| *H04S 1/00* | (2006.01) |

(52) U.S. Cl.

CPC ..... *H04R 5/033* (2013.01); *H04R 1/1016* (2013.01); *H04R 1/1041* (2013.01); *H04R 5/04* (2013.01); *H04S 1/005* (2013.01); *H04R 2420/03* (2013.01)

(58) Field of Classification Search

None

See application file for complete search history.

(56) References Cited

U.S. PATENT DOCUMENTS

| | | | |
|---|---|---|---|
| 3,794,779 | A | 2/1974 | Greuzerd et al. |
| 3,796,840 | A | 3/1974 | Ohta |
| 5,144,678 | A | 9/1992 | Lenz |
| 5,337,353 | A | 8/1994 | Boie et al. |
| 5,937,070 | A | 8/1999 | Todter |
| 6,118,878 | A | 9/2000 | Jones |
| 6,614,912 | B1 | 9/2003 | Yamada et al. |
| 6,817,440 | B1 | 11/2004 | Kim |
| 7,069,018 | B1 | 6/2006 | Granstam et al. |
| 7,925,029 | B2 | 4/2011 | Hollemans |
| 8,019,096 | B2 | 9/2011 | Sander et al. |
| 8,199,956 | B2 | 6/2012 | Haartsen et al. |
| 8,238,590 | B2 | 8/2012 | Burge |
| 8,428,053 | B2 | 4/2013 | Kannappan |
| 8,954,177 | B2 | 2/2015 | Sanders |
| 2004/0138723 | A1 | 7/2004 | Malick et al. |
| 2005/0170859 | A1 | 8/2005 | Koike et al. |
| 2005/0250553 | A1 | 11/2005 | Lim |

(Continued)

FOREIGN PATENT DOCUMENTS

| | | |
|---|---|---|
| JP | 2011105421 | 6/2011 |
| WO | 2011146659 | 11/2011 |

OTHER PUBLICATIONS

Puskarich, U.S. Appl. No. 13/547,371, filed Jul. 12, 2012.

(Continued)

*Primary Examiner* — Thang Tran

(74) *Attorney, Agent, or Firm* — Treyz Law Group; Kendall P. Woodruff

(57) ABSTRACT

An electronic device may be coupled to an accessory such as a pair of earphones. The earphones may have multi-user sensor structures that determine whether or not the earphones are being shared by multiple users. The multi-user sensor structures may include an angle sensor configured to measure an angle at the Y-junction of a cable associated with the pair of headphones. When the first and second speakers are both located in the ears of a single user, the electronic device may perform functions such as playing audio content. When one of the speakers is located in an ear of a first user while the other of the speakers is located in an ear of a second user, the electronic device can automatically take actions such as switching from stereo to mono playback, playing a different type of audio content to each earphone, or other suitable action.

20 Claims, 10 Drawing Sheets

(56) References Cited

U.S. PATENT DOCUMENTS

| | | | | |
|---|---|---|---|---|
| 2006/0013079 | A1* | 1/2006 | Rekimoto | 369/30.01 |
| 2006/0233413 | A1 | 10/2006 | Nam | |
| 2007/0076897 | A1* | 4/2007 | Philipp | 381/74 |
| 2007/0121959 | A1 | 5/2007 | Philipp | |
| 2007/0169615 | A1 | 7/2007 | Chidlaw et al. | |
| 2008/0157991 | A1 | 7/2008 | Raghunath et al. | |
| 2008/0303947 | A1 | 12/2008 | Ohnishi et al. | |
| 2009/0131124 | A1 | 5/2009 | Bibaud et al. | |
| 2009/0285408 | A1 | 11/2009 | Kimura | |
| 2010/0020998 | A1 | 1/2010 | Brown et al. | |
| 2010/0128887 | A1* | 5/2010 | Lee et al. | 381/74 |
| 2010/0183175 | A1* | 7/2010 | Chen et al. | 381/309 |
| 2010/0197360 | A1 | 8/2010 | Namgoong et al. | |
| 2010/0310087 | A1 | 12/2010 | Ishida | |
| 2010/0310097 | A1 | 12/2010 | Chang | |
| 2011/0021182 | A1 | 1/2011 | Huan | |
| 2011/0116643 | A1 | 5/2011 | Tiscareno et al. | |
| 2011/0144779 | A1 | 6/2011 | Janse et al. | |
| 2011/0187868 | A1 | 8/2011 | Chang et al. | |
| 2011/0196519 | A1 | 8/2011 | Khoury et al. | |
| 2011/0286615 | A1 | 11/2011 | Olodort et al. | |
| 2012/0086551 | A1 | 4/2012 | Lowe et al. | |
| 2012/0114154 | A1 | 5/2012 | Abrahamsson | |
| 2012/0207317 | A1 | 8/2012 | Abdollahzadeh Milani et al. | |
| 2013/0038458 | A1 | 2/2013 | Toivola | |
| 2013/0075595 | A1 | 3/2013 | Ruh | |
| 2013/0083933 | A1* | 4/2013 | Aase | 381/58 |
| 2013/0094659 | A1 | 4/2013 | Liu | |
| 2013/0163783 | A1 | 6/2013 | Burlingame | |
| 2014/0146976 | A1 | 5/2014 | Rundle | |
| 2014/0146979 | A1 | 5/2014 | Puskarich | |
| 2014/0146982 | A1 | 5/2014 | Pelosi | |

OTHER PUBLICATIONS

"Method and System is Disclosed for Modifying Audio Channel Routing Based on Operational Condition Associated with One or More Audio Devices." Jul. 16, 2010 (3 pages).

Acker et al., 'Smart Audio Output With Presence Sensors: Enabling Mode Switching Using Head Sets or Ear Buds Synaptics Incorporated, San Jose, California, Nov. 2, 2005 (10 pages).

"Automated Play/Pause of Music Based on Aggregated Sensor Data," Feb. 2, 2012 (3 pages).

Free on iPhone: Free Apps, Review for iPhone, "iPhone Proximity Sensor", posted Jan. 2, 2009, retrieved Sep. 1, 2011.

Hisahiro Moriuchi "Universal Earphones: Earphones with Automatic Side and Shared Use Detection", 2012, 1 page.

* cited by examiner

EARPHONES WITH CABLE ORIENTATION SENSORS

BACKGROUND

This relates to electronic devices and, more particularly, to electronic devices with accessories such as earphones.

Accessories such as earphones are often used with media players, cellular telephones, and other electronic devices. Users may sometimes want to share earphones to listen to audio playback at the same time. There can be difficulties associated with sharing earphones. For example, audio is typically played in stereo so that left and right earbuds receive corresponding left and right channels of audio. A user who is sharing a set of earphones with another user may therefore miss information that is being sent to the channel associated with the other user's earbud.

It would therefore be desirable to be able to provide improved ways in which to control operation of an electronic device coupled to an accessory.

SUMMARY

An electronic device may be coupled to an accessory such as a pair of earphones. The earphones may have multi-user sensor structures that determine whether or not the earphones are being used by multiple users.

The earphones may contain first and second speakers. For example, the earphones may include a left earbud and a right earbud. When both the first and second speakers are located in the ears of a single user, the electronic device may perform functions in single-user mode such as playing audio content in stereo.

When one of the speakers is located in a first user's ear and the other speaker is located in a second user's ear, the electronic device may perform functions in multiple-user mode such as providing monophonic playback to each speaker. The monophonic playback provided to each speaker may be the same so that both users hear the same audio content or may be different so that the user's hear different audio content.

The sensor structures may include one or more angle sensors. The angle sensors may be used to determine the angular orientation of each speaker in a pair of earphones to determine whether or not multiple users are wearing the earphones. The angle sensors may be formed from light-based angle sensors such as fiber optic goniometers or may be formed from gauge elements that measure the bending strain along or around a particular axis.

The accessory may include a cable having a junction at which the cable branches into first and second cable segments. The cable segments may be oriented at an angle with respect to each other. The sensor structures may be configured to measure the angle at the junction to determine whether or not the accessory is being shared by multiple users.

Further features of the invention, its nature and various advantages will be more apparent from the accompanying drawings and the following detailed description of the preferred embodiments.

DETAILED DESCRIPTION

Electronic device accessories such as earphones may be provided with cable orientation sensors configured to measure one or more angles associated with an accessory cable. For example, an accessory provided with angle sensing structures that can determine whether or not the accessory is being shared by multiple users.

Figure 1:
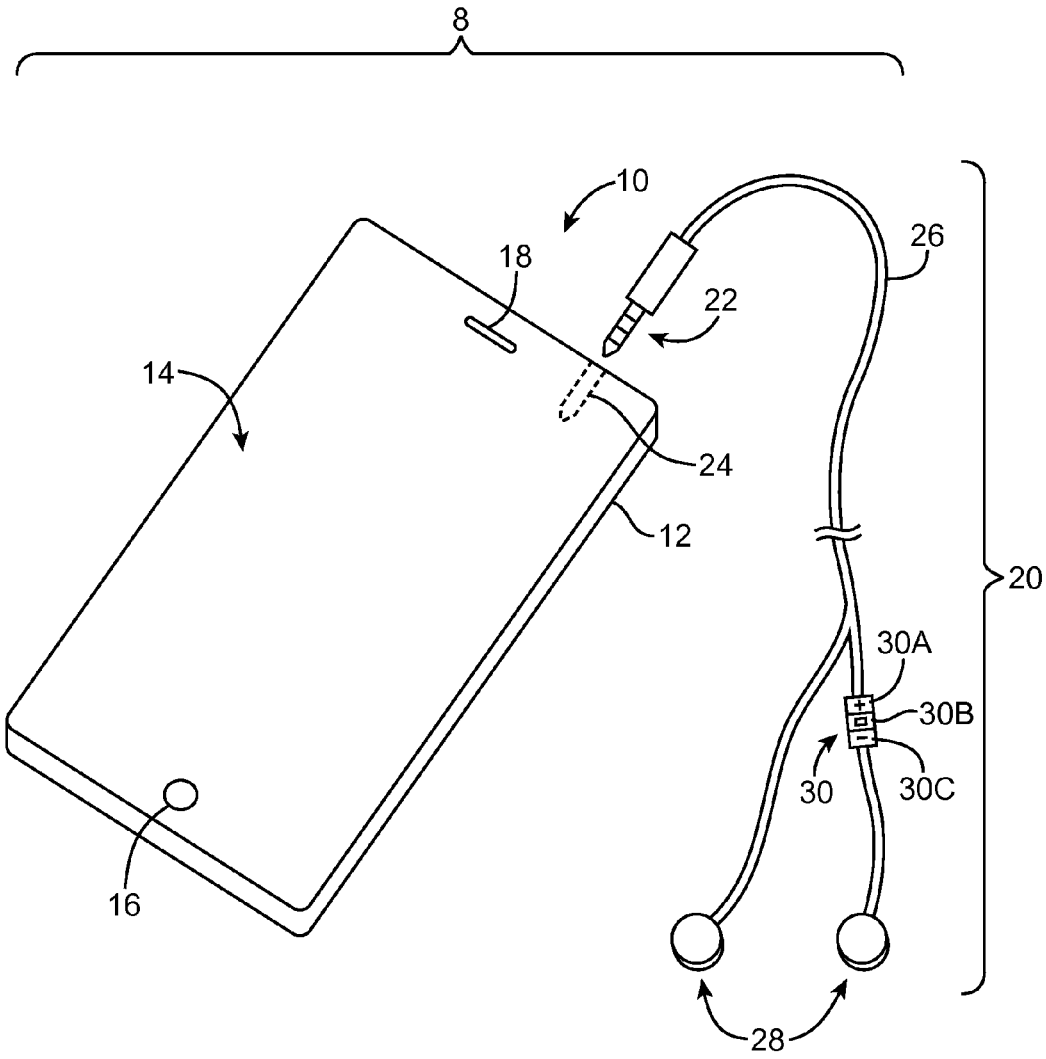
FIG. 1 is a front perspective view of an illustrative electronic device and associated accessory in accordance with an embodiment of the present invention.

FIG. 1 is a diagram of a system of the type that may be provided with an accessory having sensing structures for detecting multiple users. As shown in FIG. 1, system 8 may include electronic device 10 and accessory 20.

Electronic device 10 may include a display such as display 14. Display 14 may be a touch screen that incorporates a layer of conductive capacitive touch sensor electrodes or other touch sensor components or may be a display that is not touch-sensitive. Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. Configurations in which display 14 includes display layers that form liquid crystal display (LCD) pixels may sometimes be described herein as an example. This is, however, merely illustrative. Display 14 may include display pixels formed using any suitable type of display technology.

Display 14 may be protected using a display cover layer such as a layer of transparent glass or clear plastic. Openings may be formed in the display cover layer. For example, an opening may be formed in the display cover layer to accommodate a button such as button 16 and an opening such as opening 18 may be used to form a speaker port.

Device 10 may have a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.). The periphery of housing 12 may, if desired, include walls. One or more openings may be formed in housing 12 to accommodate connector ports, buttons, and other components. For example, an opening may be formed in the wall of housing 12 to accommodate audio connector 24 and other connectors (e.g., digital data port connectors, etc.). Audio connector 24 may be a female audio connector (sometimes referred to as an audio jack) that has two pins (contacts), three pins, four pins, or more than four pins (as examples). Audio connector 24 may mate with male audio connector 22 (sometimes referred to as an audio plug) in accessory 20.

Accessory 20 may be a pair of earphones (e.g., earbuds or earphones with other types of speakers), other audio equipment (e.g., an audio device with a single earbud unit), or other electronic equipment that communicates with electronic device 10. The use of a pair of headphones in system 8 is sometimes described herein as an example. This is, however, merely illustrative. Accessory 20 may be implemented using any suitable electronic equipment.

It should be understood that the term "earphones" may refer to any suitable type of audio headset (e.g., headphones, over-the-ear headphones, earbuds, earbud-type headphones with ear hooks, etc.).

As shown in FIG. 1, accessory 20 may include a communications path such as cable 26 that is coupled to audio plug 22. Cable 26 may contain conductive lines (e.g., wires) that are coupled to respective contacts (pins) in audio connector 22. The conductive lines of cable 26 may be used to route audio signals from device 10 to speakers in earphone units 28 (which may sometimes be referred to as speakers or earphone housings). Cable 26 may include sensor structures for determining when accessory 20 is being shared by multiple users.

Microphone signals may be gathered using a microphone mounted in controller unit 30. Controller unit 30 may also have buttons that receive user input from a user of system 8. A user may, for example, manually control the playback of media by pressing button 30A to play media or increase audio volume, by pressing button 30B to pause or stop media playback, and by pressing button 30C to reverse media playback or decrease audio volume (as examples).

The circuitry of controller 30 may communicate with the circuitry of device 10 using the wires or other conductive paths in cable 26 (e.g., using digital and/or analog communications signals). The paths in cable 26 may also be coupled to speaker drivers in earphones 28, so that audio signals from device 10 may be played through the speakers in earphone units 28. Electronic device 10 may regulate the volume of sound produced by earphone units 28 by controlling the audio signal strength used in driving the speakers in earbuds 28.

Sensor signals from sensor structures in cable 26 may be conveyed to device 10 using the conductive paths of cable 26. Electronic device 10 may process the sensor signals and take suitable action based on a determination of whether or not earphone units 28 are in the ears of multiple users.

Figure 2:
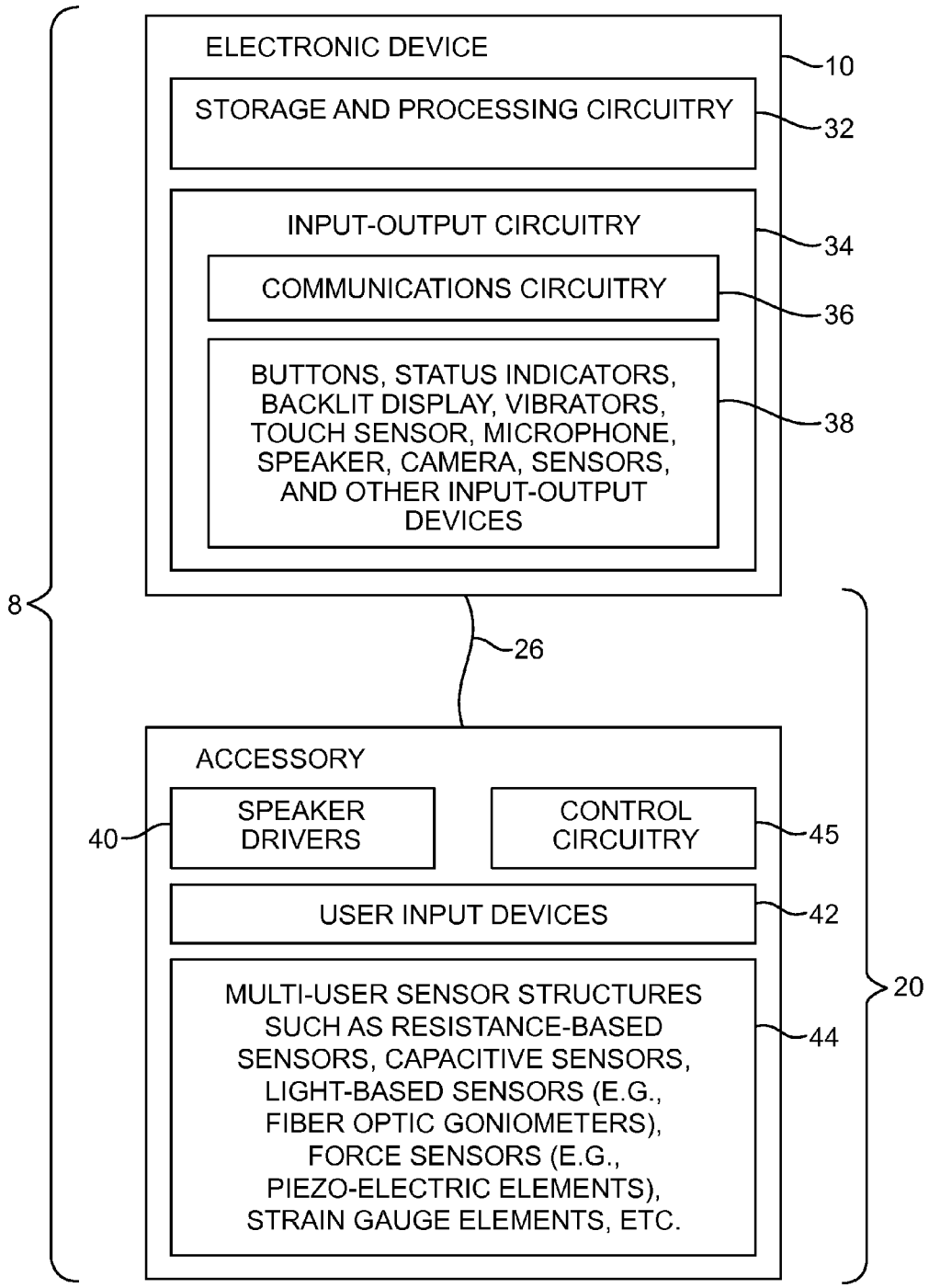
FIG. 2 is a schematic diagram of an illustrative electronic device and associated accessory in accordance with an embodiment of the present invention.

A schematic diagram showing illustrative components that may be used in device 10 and accessory 20 of system 8 is shown in FIG. 2. As shown in FIG. 2, electronic device 10 may include control circuitry 32 and input-output circuitry 34. Control circuitry 32 may include storage and processing circuitry that is configured to execute software that controls the operation of device 10. Control circuitry 32 may be implemented using one or more integrated circuits such as microprocessors, application specific integrated circuits, memory, and other storage and processing circuitry.

Input-output circuitry 34 may include components for receiving input from external equipment and for supplying output. For example, input-output circuitry 34 may include user interface components for providing a user of device 10 with output and for gathering input from a user. As shown in FIG. 2, input-output circuitry 34 may include communications circuitry 36. Communications circuitry 36 may include wireless circuitry such as radio-frequency transceiver circuitry with a radio-frequency receiver and/or a radio-frequency transmitter. Radio-frequency transceiver circuitry in the wireless circuitry may be used to handle wireless signals in communications bands such as the 2.4 GHz and 5 GHz WiFi® bands, cellular telephone bands, and other wireless communications frequencies of interest. Communications circuitry 36 may also include wired communications circuitry such as circuitry for communicating with external equipment over serial and/or parallel digital data paths.

Input-output devices 38 may include buttons such as sliding switches, push buttons, menu buttons, buttons based on dome switches, keys on a keypad or keyboard, or other switch-based structures. Input-output devices 38 may also include status indicator lights, vibrators, display touch sensors, speakers, microphones, camera sensors, ambient light sensors, proximity sensors, and other input-output structures.

Electronic device 10 may be coupled to components in accessory 20 using cables such as cable 26 of accessory 20. Accessory 20 may include speakers such as a pair of speaker drivers 40 (e.g., a left speaker and a right speaker). If desired, accessory 20 may include more than one driver per earbud. For example, each earbud in accessory 20 may have a tweeter, a midrange driver, and a bass driver (as an example). Speaker drivers 40 may be mounted in earbuds or other types of earphone housings. The use of left and right earbuds to house respective left and right speaker drivers 40 is sometimes described herein as an example.

If desired, accessory 20 may include user input devices 42 such as buttons (see, e.g., the buttons associated with button controller 30 of FIG. 1), touch-based input devices (e.g., touch screens, touch pads, touch buttons), a microphone to gather voice input, and other user input devices.

To determine whether or not accessory 20 is being shared by multiple users, accessory 20 may be provided with multi-user sensor structures 44. Multi-user sensor structures 44 may be configured to detect whether or not the earbuds (or other earphone units of accessory 20) are being used by multiple users. Multi-user sensor structures may be formed from strain gauge elements, from light-based sensors such as optical fiber goniometers, from force sensors, from switches or other mechanical sensors, from capacitive sensors, from resistance-based sensors, and from acoustic-based sensors such as ultrasonic acoustic-based sensors (as examples).

Control circuitry 45 in accessory 20 (e.g., storage and processing circuits formed from one or more integrated circuits or other circuitry) and/or control circuitry 32 of electronic device 10 may use information from multi-user sensor structures 44 in determining which actions should be automatically taken by device 10.

Figure 3:
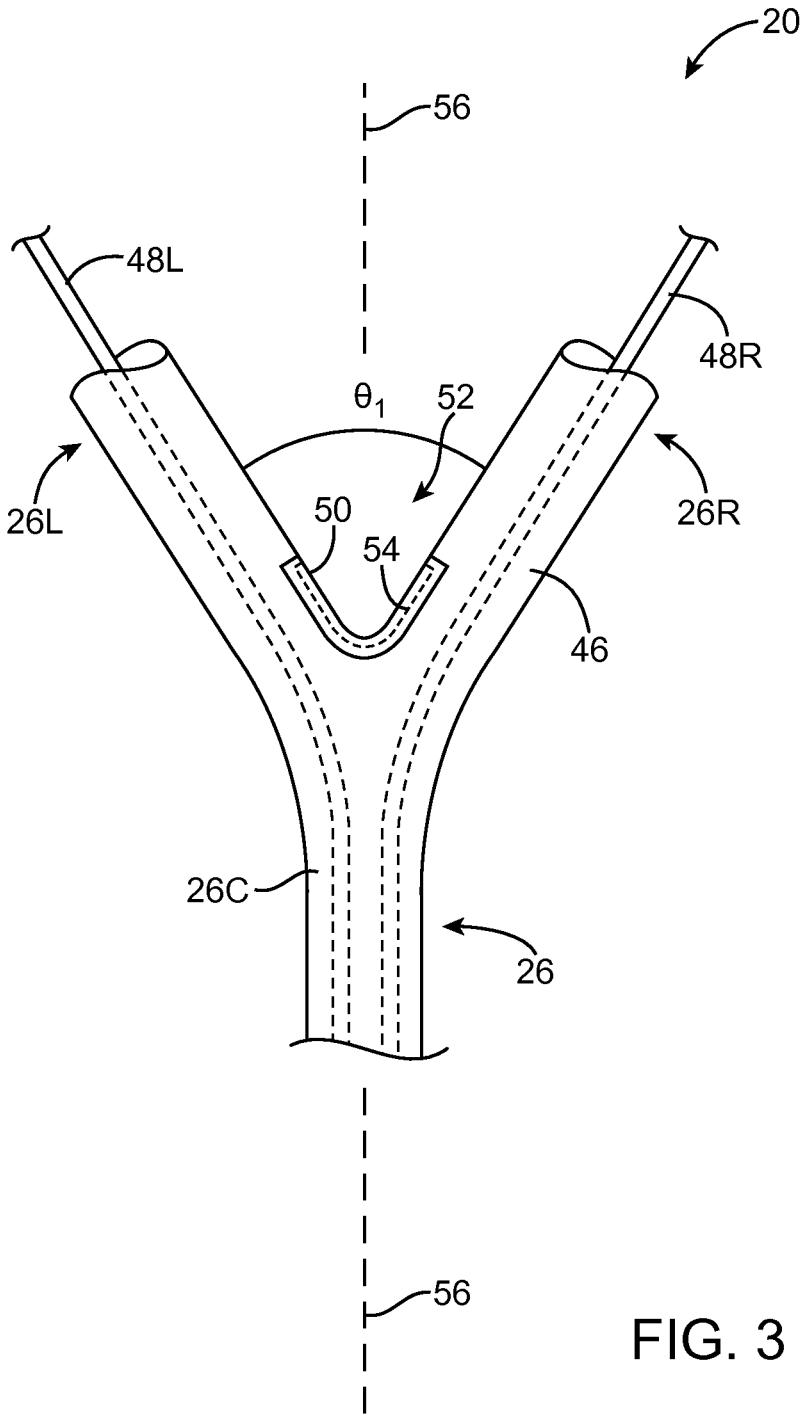
FIG. 3 is a perspective view of a portion of an illustrative accessory having a cable orientation sensor formed from a strain gauge in accordance with an embodiment of the present invention.

A portion of an illustrative accessory with a multi-user presence sensor is shown in FIG. 3. As shown in FIG. 3, accessory 20 has a tubular insulative sheath such as sheath 46 that surrounds one, two, or more than two wires. In the FIG. 3 example, sheath 46 surrounds conductive wire bundles 48L and 48R. Wire bundle 48L may be electrically coupled between connector 22 and a left earbud 28 (FIG. 1), whereas wire bundle 48R may be electrically coupled between connector 22 and a right earbud 28.

As shown in FIG. 3, cable 26 may have a junction such as junction 52 (sometimes referred to as a Y-junction) at which common cable portion 26C branches into two cable segments 26L and 26R. Cable segments 26L and 26R may be oriented at an angle with respect to each other. The angle that separates left branch 26L from right branch 26R may be indicative of whether or not accessory 20 is being shared between multiple users. For example, a relatively large angle between left branch 26L and right branch 26R may indicate that one earbud 28 is in a first user's ear while the other earbud 28 is in a second user's ear.

A gauge element such as strain gauge element 50 may be formed at Y-junction 52 of cable 26. As shown in FIG. 3, strain gauge element 50 may include conductive lines such as conductive lines 54 (e.g., a pattern of metallic foil or other suitable conductive material). Conductive lines 54 may be formed directly on the inner surface of sheath 46 or may, if desired, be formed on a flexible support structure that has been attached to the inner surface of sheath 46 (e.g., with adhesive).

As conductive lines 54 are strained or deformed (e.g., by being flexed or strained about axis 56), the electrical resistance of strain gauge 50 may change. For example, as $\theta_1$ between left branch 26L and right branch 26R increases, conductive lines 54 on strain gauge 50 will be stretched, thereby increasing the electrical resistance of strain gauge 50. As $\theta_1$ between left branch 26L and right branch 26R decreases, conductive lines 54 on strain gauge 50 will be compressed, thereby decreasing the electrical resistance of strain gauge 50.

The strain of cable 26 at Y-junction 52 measured by strain gauge 50 may be proportional to the angle $\theta_1$ between left branch 26L and right branch 26R of cable 26. Thus, strain gauge 50 may serve as an angle sensor (sometimes referred to as a goniometer) for measuring the angle $\theta_1$ between left branch 26L and right branch 26R of cable 26.

To determine whether or not accessory 20 is being shared by multiple users, the control circuitry of accessory 20 (and/or control circuitry 32 of FIG. 2) may measure the angle $\theta_1$ between left branch 26L and right branch 26R of cable 26 using strain gauge 50. The control circuitry may compare the measured angle with a predetermined threshold. When the measured angle is above the predetermined threshold, device 10 can conclude that accessory 20 is being shared by multiple users. When the measured angle is below the predetermined threshold, device 10 can conclude that accessory 20 is not being shared by multiple users.

Figure 4:
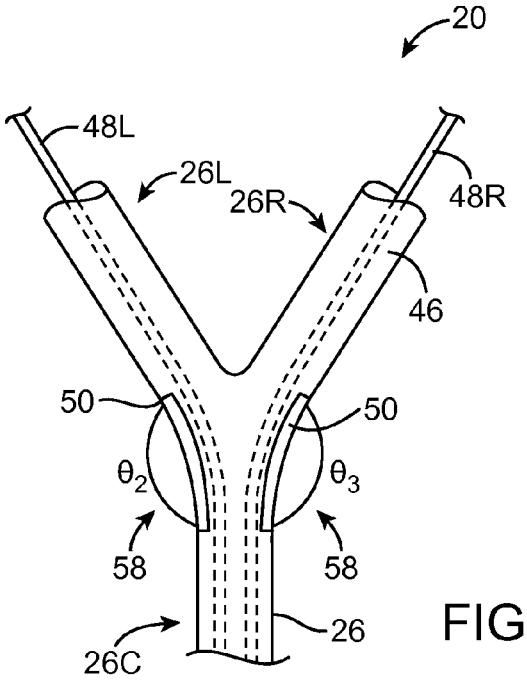
FIG. 4 is a perspective view of a portion of an illustrative accessory having cable orientation sensors formed from strain gauges in accordance with an embodiment of the present invention.

If desired, strain gauges 50 may be formed in other locations of cable 26. For example, as shown in FIG. 4, strain gauge elements 50 may be formed in outer portions 58 of cable 26. Similar to the example of FIG. 3, strain gauge elements 50 of FIG. 4 may be formed on an inner surface of cable sheath 46. With this type of configuration, a first strain gauge 50 may be configured to measure the angle $\theta_2$ between left branch 26L of cable 26 and common cable portion 26C (e.g., the portion of cable 26 that surrounds both wires 48L and 48R), while a second strain gauge 50 may be configured to measure the angle $\theta_3$ between right branch 26R of cable 26 and common cable portion 26C.

Control circuitry 45 in accessory 20 or circuitry 32 in device 10 may compare $\theta_2$ and/or $\theta_3$ with a predetermined threshold. When one or both measured angles is above the predetermined threshold, device 10 can conclude that accessory 20 is not being shared by multiple users. When one or both measured angles is below the predetermined threshold, device 10 can conclude that accessory 20 is being shared by multiple users.

Figure 5:
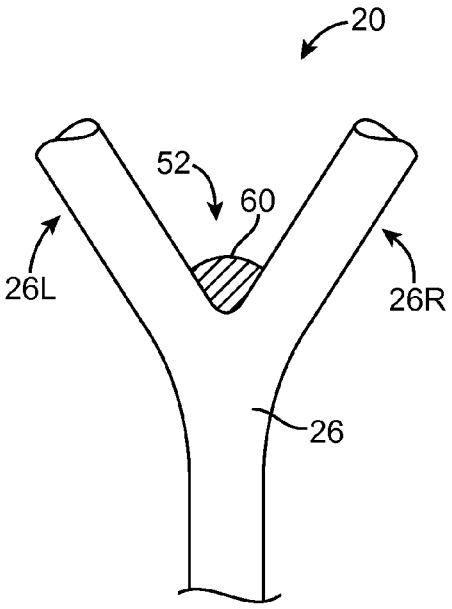
FIG. 5 is a perspective view of a portion of an illustrative accessory having a cable orientation sensor formed from a resistance-based angle sensor in accordance with an embodiment of the present invention.

If desired, accessory 20 may be provided with forced-based sensors or resistance-based sensors for determining whether or not accessory 20 is being shared by multiple users. For example, as shown in FIG. 5, multi-user sensor structure 60 may be formed in the crevice of Y-junction 52. Sensor structure 60 may, for example, be a compressible foam with a measureable resistance. As the angle between left branch 26L and right branch 26R of cable 26 increases, the resistance of foam 60 may also increase. As the angle between left branch 26L and right branch 26R of cable 26 decreases, the resistance of foam 60 may decrease. When control circuitry of accessory 20 or device 10 determines that the resistance is above a predetermined threshold, device 10 can conclude that accessory 20 is being shared by multiple users.

If desired, forced-based sensor schemes such as piezoelectric force sensors or other force sensors may be used to determine whether or not accessory 20 is being shared by multiple users.

Figure 6:
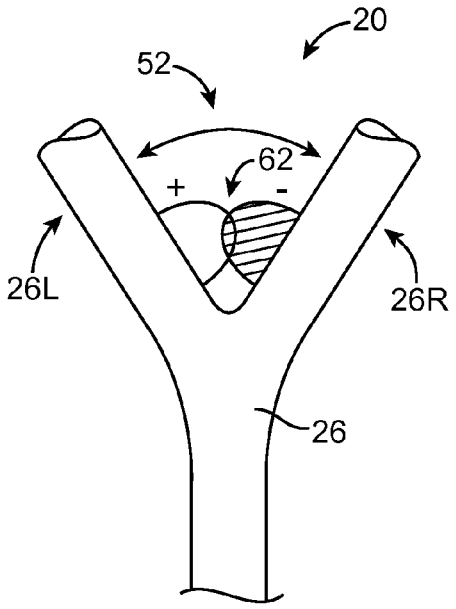
FIG. 6 is a side view of a portion of an illustrative accessory having a cable orientation sensor formed from a capacitive angle sensor in accordance with an embodiment of the present invention.

Capacitive sensors may also be used to determine whether or not accessory 20 is being shared my multiple users. For example, as shown in FIG. 6, sensor 62 may include first and second electrical conductors formed at Y-junction 52 of cable 26. A first conductive plate (e.g., a metal foil or other conductive structure) may be formed on left branch 26L of cable 26 and a second may be formed on right branch 26R of cable 26. As the angle between left branch 26L and right branch 26R decreases, the overlapping area between the conductive plates may increase, thereby increasing the capacitance of sensor structure 62. As the angle between left branch 26L and right branch 26R increases, the overlapping area between the conductive plates may decrease, thereby decreasing the capacitance of sensor structure 62. When control circuitry of accessory 20 or device 10 determines that the capacitance is below a predetermined threshold, device 10 can conclude that accessory 20 is being shared by multiple users.

If desired, other capacitive sensors may be used to determine whether or not accessory 20 is being shared by multiple users. The example of FIG. 6 is merely illustrative.

Light-based sensors such as fiber optic goniometers may also be used to determine whether or not accessory 20 is being shared by multiple users. For example, a fiber optic goniometer may be used to measure the angle between left and right branches of cable 26, or the angle between a left or right branch of cable 26 and the common portion of cable 26. A diagram illustrating how fiber optic goniometers may be used to measure angles is shown in FIG. 7.

Figure 7:
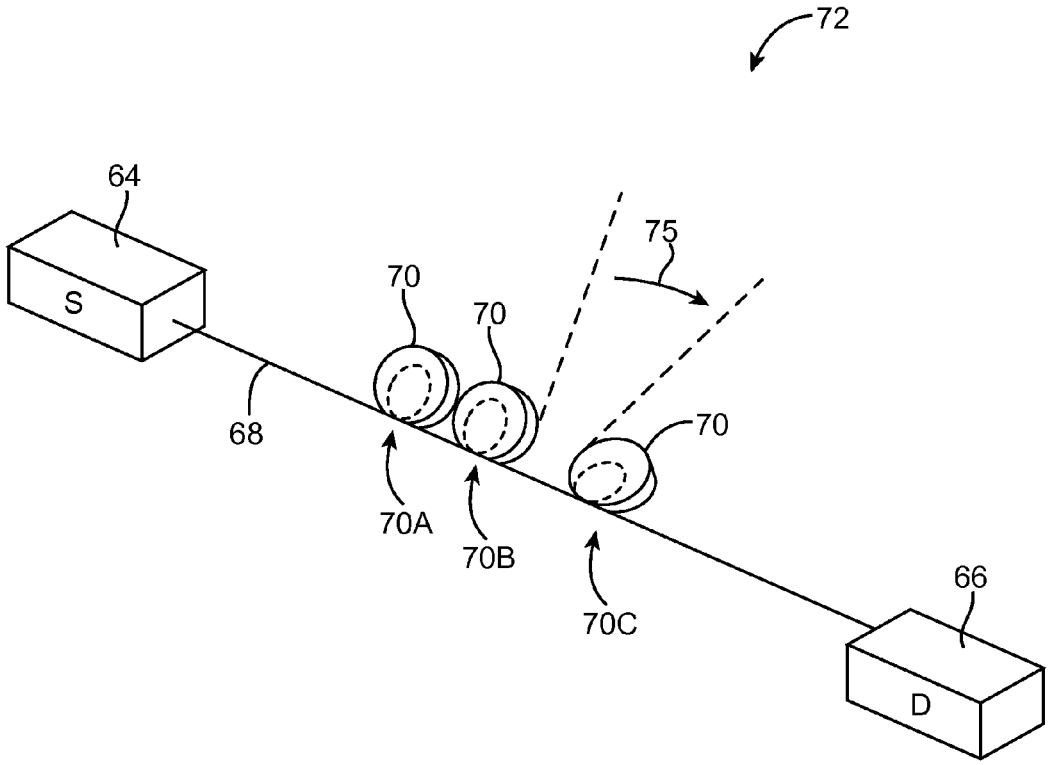
FIG. 7 is a diagram of an illustrative fiber optic goniometer that may be used to measure cable orientation in accordance with an embodiment of the present invention.

As shown in FIG. 7, fiber optic goniometer 72 may include a fiber optic cable such as fiber optic cable 68 interconnected between a light source such as light source 64 and a light detector such as light detector 66. Light source 64 may include, for example, one or more laser diodes, one or more light-emitting diodes, or other sources of light. Light detector 66 may include one or more photodetectors such as p-i-n diodes, p-n junction diodes, photodiode arrays, etc.

Fiber optic cable 68 may be looped around a series of three wave-plate structures such as wave-plate structures 70. Wave-plate structures 70 may, for example, include a half-wave-plate sandwiched between two quarter-wave-plates. Goniometer 72 may also include one or more polarizers such as linear polarizers for creating linearly polarized light.

As light passes through fiber optic cable 68, a change in polarization occurs when the plane of wave-plate 70C rotates with respect to the plane of wave-plates 70A and 70B. For example, when the plane of wave-plate 70C rotates in direction 75 relative to the plane of wave-plates 70A and 70B, a change in polarization of the light within fiber 68 occurs. The rotation angle may be determined from the intensity of light received by photodetector 66.

Figure 8:
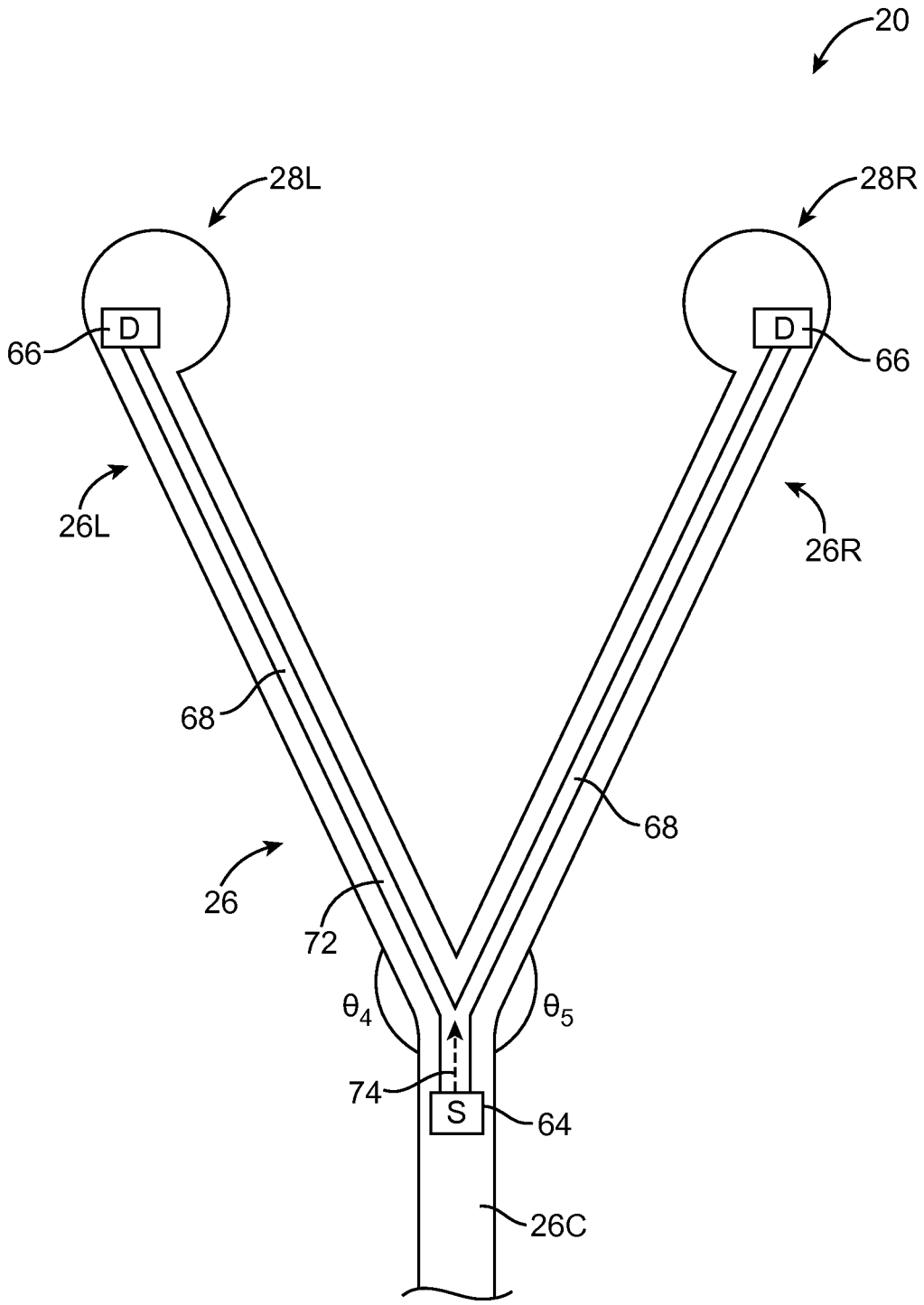
FIG. 8 is a cross-sectional diagram of a portion of an illustrative accessory having a cable orientation sensor formed from a fiber optic goniometer in accordance with an embodiment of the present invention.

FIG. 8 is an illustrative example showing how a fiber optic goniometer of the type shown in FIG. 7 may be used to determine whether or not accessory 20 is being shared by multiple users. In the example of FIG. 8, light source 64 is located in common portion 26C of cable 26 and emits light into fiber optic cable 68 in direction 74. A light detector such as light detector 66 may be located in each earbud 28. Light source 64 may emit light into a single optical fiber that splits into two fiber segments (e.g., with a first fiber segment associated with left branch 26L and a second fiber segment associated with right branch 26R) or, if desired, light source 64 may be optically coupled to two optical fibers 68 that are separate from each other. In either case, a set of wave-plates such as wave-plates 70 may be located at each bending location where the angle is to be measured.

In the example of FIG. 8, goniometer 72 is configured to measure the angle $\theta_4$ between left branch 26L and common portion 26C of cable 26 and to measure the angle $\theta_5$ between right branch 26R and common portion 26C of cable 26.

Control circuitry 45 in accessory 20 or circuitry 32 in device 10 may compare $\theta_4$ and/or $\theta_5$ with a predetermined threshold. When one or both measured angles is above the predetermined threshold, device 10 can conclude that accessory 20 is not being shared by multiple users. When one or both measured angles is below the predetermined threshold, device 10 can conclude that accessory 20 is being shared by multiple users.

Figure 9:
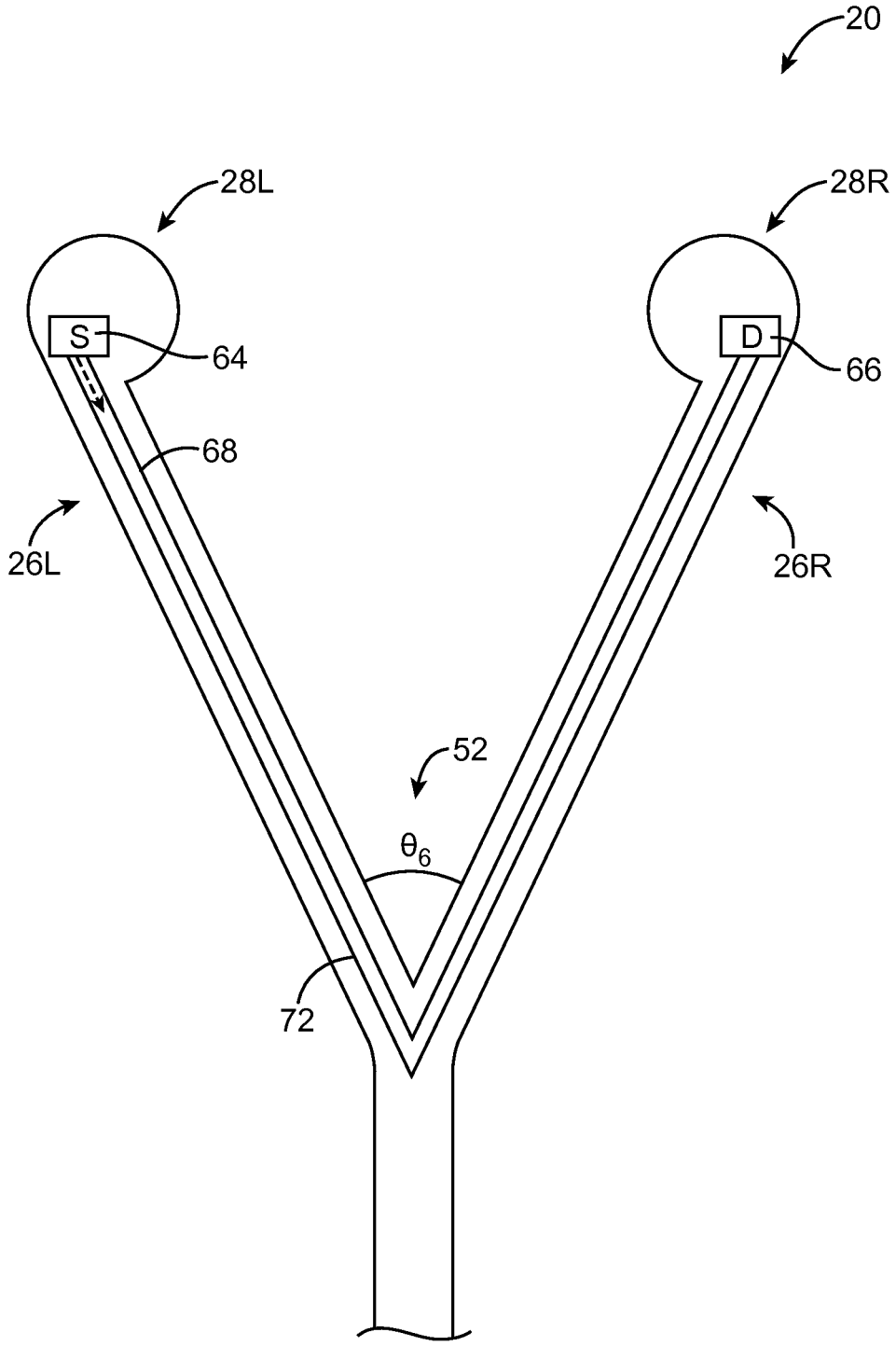
FIG. 9 is a cross-sectional diagram of a portion of an illustrative accessory having a cable orientation sensor formed from a fiber optic goniometer in accordance with an embodiment of the present invention.

The configuration of FIG. 8 in which light source 64 is located in common portion 26C of cable 26 and in which light detectors 66 are located in both earbuds 28 is merely illustrative. If desired, goniometer 72 may have a configuration of the type shown in FIG. 9. In the example of FIG. 9, light source 64 is located in one of earbuds 28 and light detector 66 is located in the other of earbuds 28. Fiber optic cable 68 may be coupled between light source 64 and light detector 66 such that cable 68 forms a V-shape with a bend at Y-junction 52 of cable 26.

With this type of configuration, goniometer 72 may be configured to measure the angle $\theta_6$ between left branch 26L and right branch 26R of cable 26. When this angle is determined to be above a predetermined threshold, device 10 may conclude that accessory 20 is being shared by multiple users.

The example of FIG. 9 in which light source 64 is located in left earbud 28L and light detector 66 is located in right earbud 28R is merely illustrative. If desired, light source 64 may be located in right earbud 28R and light detector 66 may be located left earbud 28L.

Figure 10:
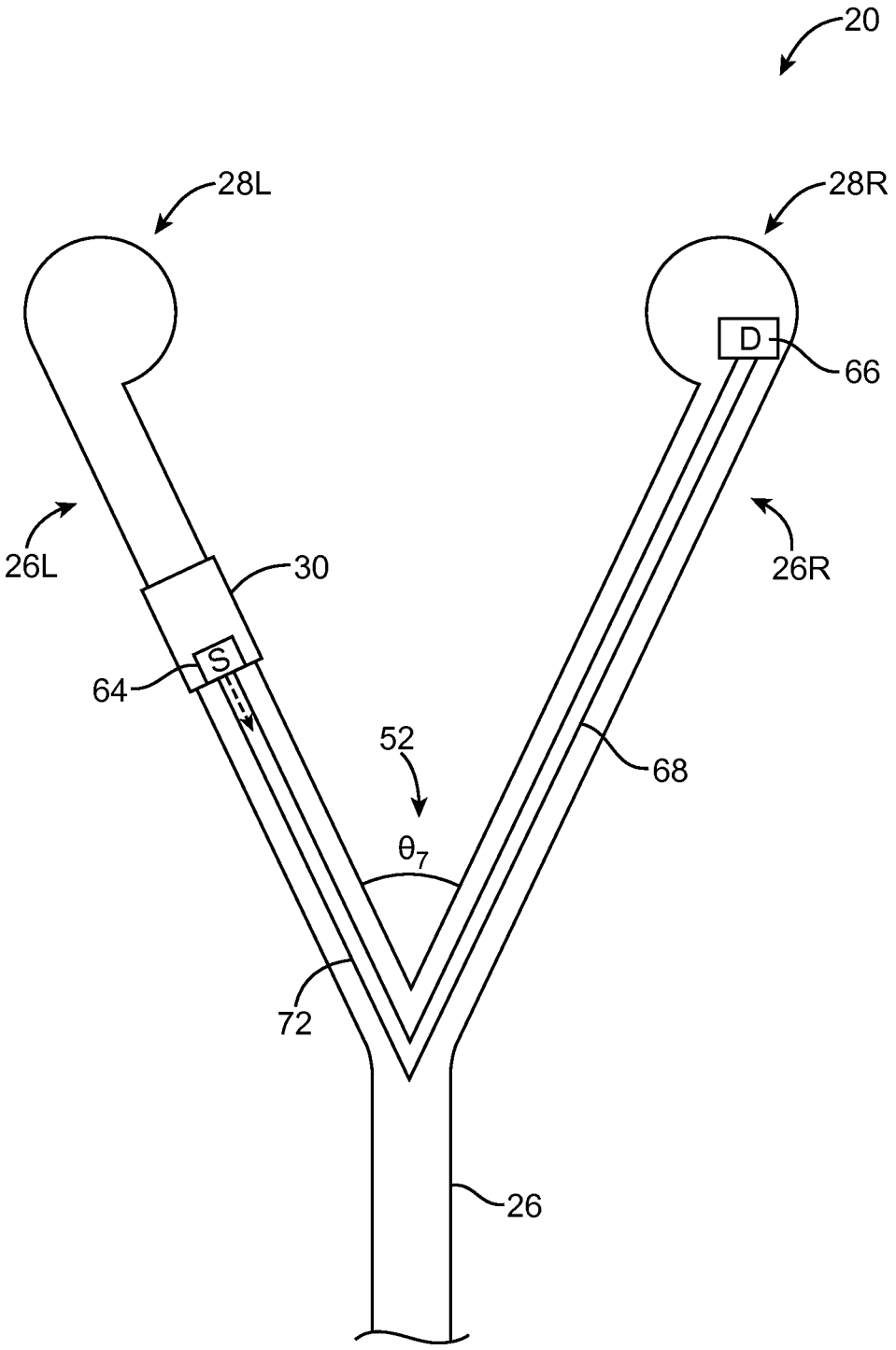
FIG. 10 is a cross-sectional diagram of a portion of an illustrative accessory having a cable orientation sensor formed from a fiber optic goniometer in accordance with an embodiment of the present invention.

Another illustrative configuration in which a fiber optic goniometer is used to determine whether or not accessory 20 is being shared by multiple users is shown in FIG. 10. In the example of FIG. 10, light source 64 is located in controller unit 30 of accessory 20 (e.g., associated with left branch 26L of cable 26) and light detector 66 is located in earbud 28 (e.g., in right earbud 28R). Fiber optic cable 68 may be coupled between light source 64 and light detector 66 such that cable 68 forms a partial V-shape with a bend at Y-junction 52 of cable 26.

Goniometer 72 of FIG. 10 may be similar to that of FIG. 9 in that it is configured to measure the angle $\theta_7$ between left branch 26L and right branch 26R of cable 26. When this angle is determined to be above a predetermined threshold, device 10 may conclude that accessory 20 is being shared by multiple users.

Figure 11:
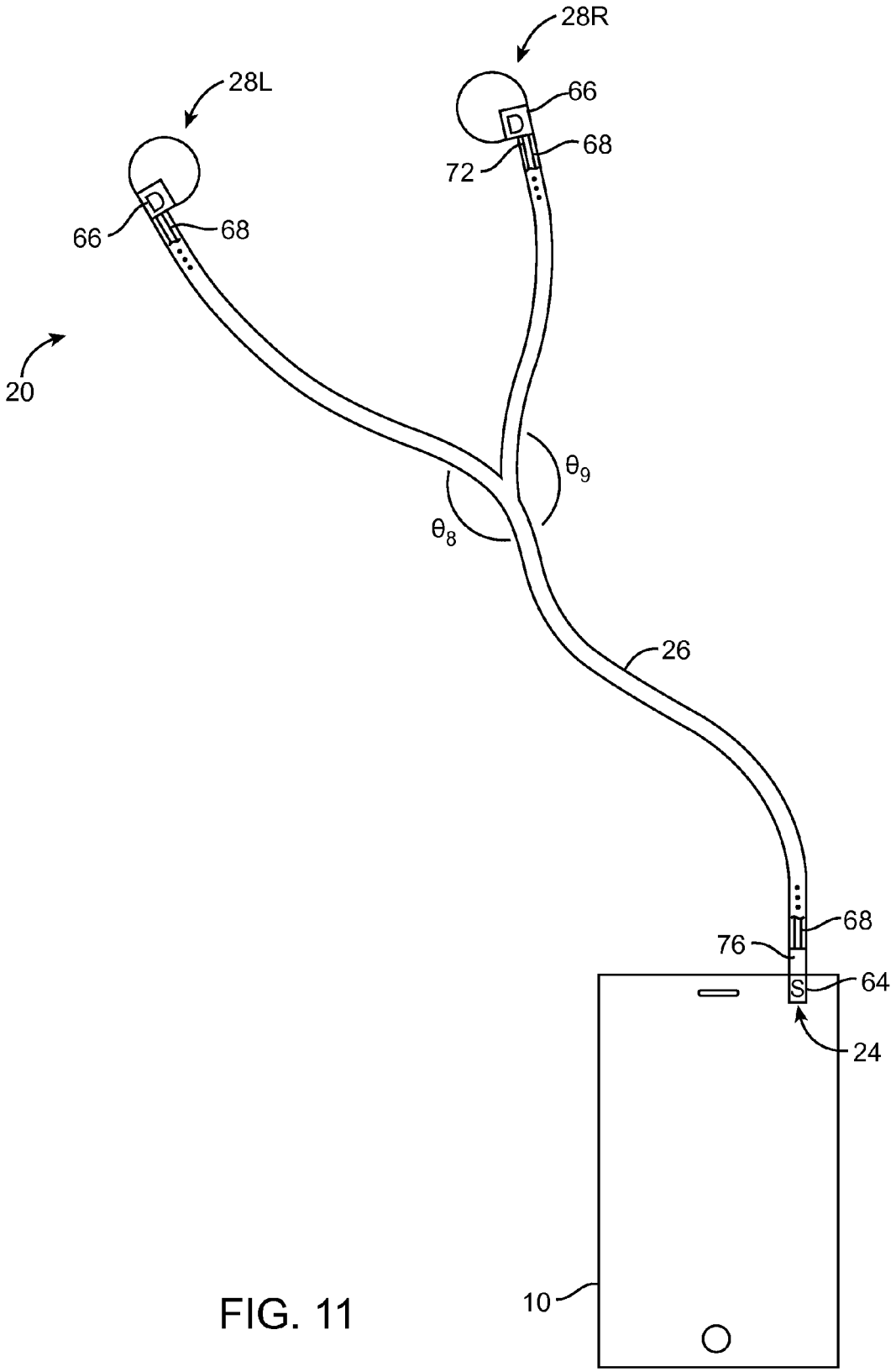
FIG. 11 is a cross-sectional diagram of an illustrative electronic device and associated accessory having a cable orientation sensor formed from a fiber optic goniometer in accordance with an embodiment of the present invention.

If desired, light source 64 may be located in electronic device 10. An illustrative example in which light source 64 is located in device 10 is shown in FIG. 11. As shown in FIG. 11, a light source such as light source 64 may be located in connector 24 of device 10 and a light detector such as light detector 66 may be located in each earbud of accessory 20. With this type of arrangement, connector 24 may be configured to support both optical as well as electrical connections with accessory 20. Accessory 20 may include an optical coupling member such as optical coupling member 76 for coupling optical fiber 68 of goniometer 72 with light source 64 in connector 24 of device 10. Light source 64 may emit light into a single optical fiber that splits into two fiber segments (e.g., with a first fiber segment associated with left branch 26L and a second fiber segment associated with right branch 26R) or, if desired, light source 64 may be optically coupled to two optical fibers 68 that are separate from each other.

Similar to the configuration of goniometer 72 of FIG. 8, goniometer 72 of FIG. 11 may be configured to measure the angle $\theta_8$ between left branch 26L and common portion 26C of cable 26 and to measure the angle $\theta_9$ between right branch 26R and common portion 26C of cable 26.

Control circuitry 45 in accessory 20 or circuitry 32 in device 10 may compare $\theta_8$ and/or $\theta_9$ with a predetermined threshold. When one or both measured angles is above the predetermined threshold, device 10 can conclude that accessory 20 is not being shared by multiple users. When one or both measured angles is below the predetermined threshold, device 10 can conclude that accessory 20 is being shared by multiple users.

Figure 12:
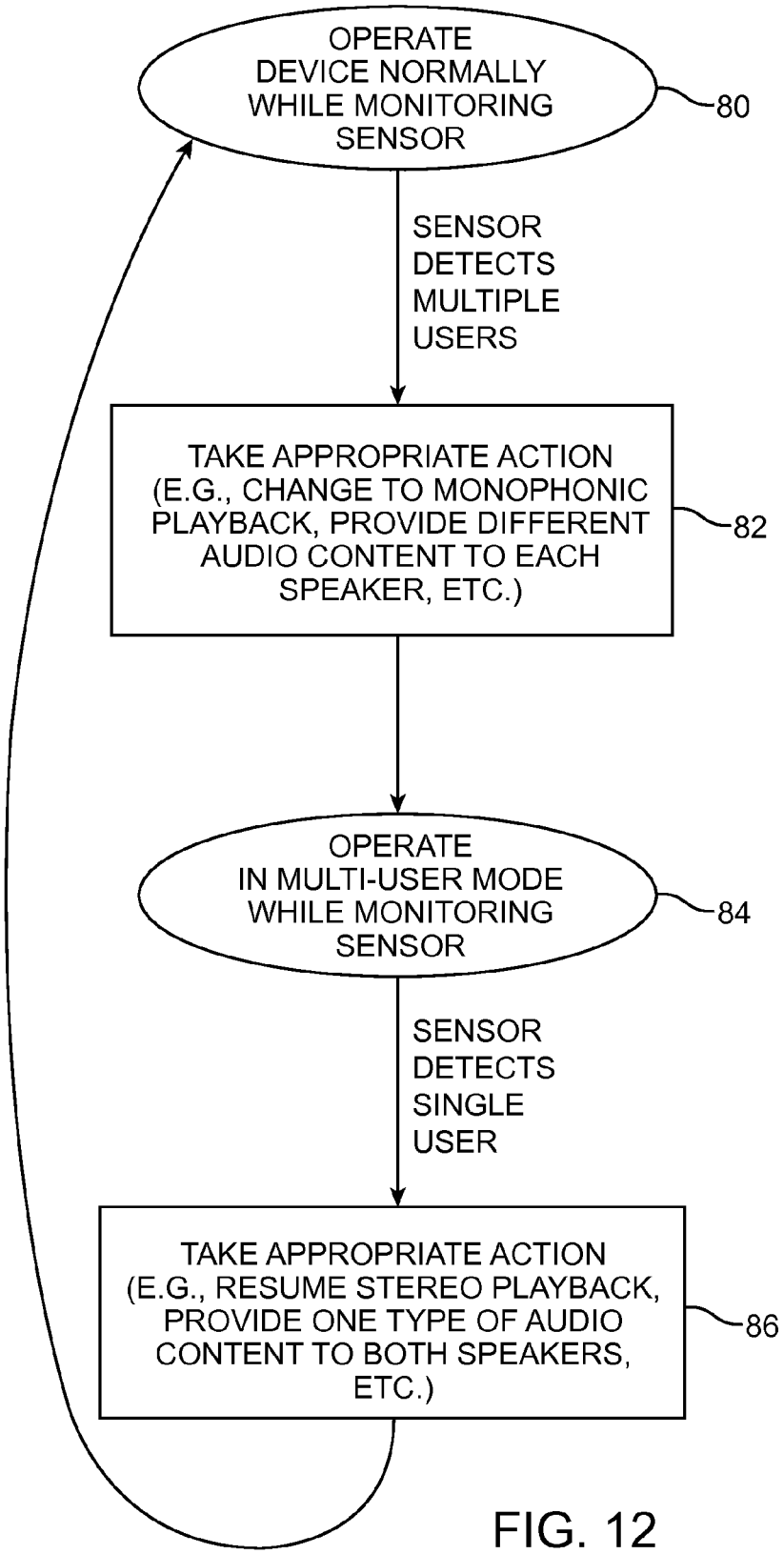
FIG. 12 is a flow chart of illustrative steps involved in operating an accessory and electronic device in accordance with an embodiment of the present invention.

FIG. 12 is a flow chart of illustrative steps involved in using system 8. During the operations of step 80, earbuds 28 may be located in the ears of a single user and device 10 may be operated normally (e.g., in single-user mode) while using sensor circuitry 44 to monitor for earbuds 28 being shared among multiple users. Circuitry 32 (and/or circuitry 45, if desired) may be used in evaluating sensor data and taking appropriate action. Configurations in which control circuitry 32 is used in taking action based on sensor data are sometimes described herein as an example.

Examples of operations that may be performed by device 10 during step 80 include audio-based operations such as playing media content, providing a user with audio associated with a telephone call, providing audio associated with a video chat session to the user, or otherwise presenting audio content through earbuds 28. Audio may be played in a stereophonic (stereo) sound scheme so that left and right earbuds receive corresponding left and right channels of audio, may be played using a multi-channel surround sound scheme, or may be played using a monophonic (mono) sound scheme in which both the left and right channels of audio are identical.

During the monitoring operation of step 80, device 10 can use multi-user sensor structures 44 to determine whether or not accessory 20 is being shared among multiple users. For example, sensors 44 may determine whether or not one earbud 28 is in a first user's ear while the other earbud 28 is in a second user's ear.

If it is determined that multiple users are sharing accessory 20 (e.g., that one earbud is in a first user's ear and the other earbud is in a second user's ear), device 10 can take appropriate action at step 82. For example, in response to determining that multiple user's are sharing accessory 20, control circuitry 45 and/or 32 may automatically switch from single-user mode to multiple user mode. This may include switching the type of audio playback scheme that is being used from multichannel or stereo sound to mono sound. Because each user is only wearing one of the earbuds in his or her ear, the use of stereo playback scheme is no longer appropriate and could cause the user to miss information that is being sent to the channel associated with the absent earbud (e.g., the earbud being worn by the other user).

As another example, detection of multiple users sharing accessory 20 may indicate that different content is desired simultaneously. For example, two users may prefer to listen to different audio content at the same time using the same pair of headphones. Accordingly, in response to detection of multiple users using accessory 20, device 10 may automatically provide two different types of audio content (e.g., a first type of audio content to left earbud 28L and a second type of audio content to right earbud 28R). Whether or not this type of action is taken in response to detection of multiple users may be based on user preferences (e.g., based on settings previously chosen by a user). If desired, the two different types of content provided to each earbud 28 may also be based on user preferences. Other actions may be taken in response to detection of multiple users using accessory 20. These examples are merely illustrative.

Following the operations of step 82, control circuitry 32 may, at step 84, operate device 10 in a multiple-user mode. In particular, device 10 may operate in a mono audio mode and/or may operate in a mode in which different types of audio playback are provided to each speaker in earbuds 28 (as examples). While operating device 10 and accessory 20 in multiple-user mode, control circuitry 32 and/or 45 may use multi-user sensor structures 44 to monitor for changes in the status of accessory 20 (e.g., to monitor for changes in the angle between left and right branches of cable 26 or for changes in the angle between a left or right branch and the common portion of cable 26).

If, during the operations of step 84, device 10 senses that both earbuds are located in the ears of a single user, appropriate action may be taken at step 86. For example, device 10 may switch from multiple-user mode to single-user mode. This may include, for example, switching the audio mode from mono to stereo (or other multi-channel audio mode) and/or resuming the playback of one type of audio content. Operations may then proceed to step 80, where device 10 may operate in a single-user mode while monitoring multi-user sensor structures 44 to determine whether or not multiple users are sharing accessory 20.

The foregoing is merely illustrative of the principles of this invention and various modifications can be made by those skilled in the art without departing from the scope and spirit of the invention. The foregoing embodiments may be implemented individually or in any combination.

What is claimed is:

1. A method for operating an electronic device that is configured to play audio through a pair of earphones having a cable, comprising:

with control circuitry in the electronic device, gathering information from sensor structures in the cable of the earphones, wherein the information indicates an orientation of the cable;

determining whether the earphones are in the ears of multiple users of the electronic device based on the information; and in response to determining whether the earphones are in the ears of multiple users of the electronic device based on the information from the sensor structures, adjusting audio playback from the control circuitry to the earphones.

2. The method defined in claim 1 wherein adjusting audio playback comprises switching between a single-user mode and a multiple-user mode.

3. The method defined in claim 1 wherein the information from the sensor structures indicates that the earphones are in the ears of the multiple users of the electronic device and wherein adjusting the audio playback comprises switching from a stereo playback mode to a mono playback mode in response to the information indicating that the earphones are in the ears of the multiple users.

4. The method defined in claim 1 wherein the information from the sensor structures indicates that the earphones are in the ears of the multiple users of the electronic device and wherein adjusting the audio playback comprises providing a first type of audio content to a first earphone in the pair of earphones and a second type of audio content to a second earphone in the pair of earphones in response to the information indicating that the earphones are in the ears of the multiple users.

5. The method defined in claim 1 wherein the information from the sensor structures indicates that the earphones are in the ears of a single user of the electronic device and wherein adjusting the audio playback comprises switching from a monophonic playback mode to a stereo playback mode in response to the information indicating that the earphones are in the ears of the single user.

6. The method defined in claim 1 wherein the information from the sensor structures indicates that the earphones are in the ears of a single user of the electronic device and wherein adjusting the audio playback comprises playing one type of audio content to both of the earphones in response to the information indicating that the earphones are in the ears of the single user.

7. Earphones operable to play audio from an electronic device, comprising:

an audio connector that is adapted to mate with an audio connector in the electronic device;

a cable coupled to the audio connector;

left and right earphone speaker housings coupled to the cable;

left and right speaker drivers, wherein the left speaker driver is mounted in the left speaker housing and wherein the right speaker driver is mounted in the right speaker housing; and sensor structures configured to measure an angle associated with the cable.

8. The earphones defined in claim 7 wherein the cable has a common cable portion that splits into two cable portions at a junction, wherein the two cable portions are oriented at the angle with respect to each other at the junction, and wherein the sensor structures comprise an angle sensor that is configured to measure the angle at the junction.

9. The earphones defined in claim 8 wherein the two cable portions are coupled respectively to the left and right earphone speaker housings.

10. The earphones defined in claim 7 wherein the sensor structures comprise a fiber optic goniometer.

11. The earphones defined in claim 10 wherein the fiber optic goniometer comprises a light source and a light detector.

12. The earphones defined in claim 7 wherein the sensor structures comprise a strain gauge.

13. The earphones defined in claim 12 wherein the cable comprises an insulative sheath surrounding a plurality of wires and wherein the strain gauge comprises conductive lines formed on an inner surface of the insulative sheath.

14. The earphones defined in claim 7 wherein the sensor structures comprise a resistance-based sensor.

15. The earphones defined in claim 14 wherein the sensor structures comprise a capacitive sensor.

16. A method for operating a pair of earphones having a cable with a junction at which the cable branches into first and second cable segments each of which has a respective earphone speaker, comprising:

with angle sensor structures in the cable, measuring an angle that separates the first and second cable segments at the junction to determine whether the pair of earphones is being shared by multiple users; and adjusting audio playback to each earphone speaker in response to determining whether the pair of earphones is being shared by multiple users from measurement of the angle.

17. The method defined in claim 16 wherein adjusting the audio playback comprises switching from single-user mode to multiple-user mode in response to determining that the pair of earphones is being shared by multiple users.

18. The method defined in claim 17 wherein the single-user mode comprises a stereo playback mode and wherein the multiple-user mode comprises a monophonic playback mode.

19. The method defined in claim 16 wherein the angle sensor structures comprise a strain gauge located at the junction and wherein determining whether the pair of headphones is being shared by multiple users comprises comparing the measured angle at the junction with a predetermined threshold.

20. The method defined in claim 16 wherein the angle sensor structures comprise a fiber optic goniometer and wherein determining whether the pair of headphones is being shared by multiple users comprises comparing the measured angle at the junction with a predetermined threshold.

* * * * *